US008687034B2

(12) United States Patent
Yoneyama et al.

(10) Patent No.: US 8,687,034 B2
(45) Date of Patent: Apr. 1, 2014

(54) EXPOSURE APPARATUS AND IMAGE FORMING APPARATUS

(75) Inventors: Hirohito Yoneyama, Kanagawa (JP); Yohei Nishino, Kanagawa (JP); Takashi Matsumura, Kanagawa (JP); Yoshinori Yamaguchi, Kanagawa (JP); Kiyokazu Mashimo, Kanagawa (JP); Katsuhiro Sato, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 41 days.

(21) Appl. No.: 12/938,045

(22) Filed: Nov. 2, 2010

(65) Prior Publication Data

US 2011/0228031 A1 Sep. 22, 2011

(30) Foreign Application Priority Data

Mar. 18, 2010 (JP) ..... 2010-062989

(51) Int. Cl.
*B41J 2/45* (2006.01)
*B41J 2/415* (2006.01)
*B41J 2/40* (2006.01)

(52) U.S. Cl.
USPC ..... 347/238; 347/128; 347/130; 347/142

(58) Field of Classification Search
USPC ..... 347/130, 142, 238, 128
See application file for complete search history.

(56) References Cited

U.S. PATENT DOCUMENTS 6,249,304 B1 * 6/2001 Sawayama et al. ..... 347/228
7,256,814 B2 8/2007 Tsujino et al.
7,425,971 B2 9/2008 Yamazaki et al.
7,485,886 B2 * 2/2009 Nakajima ..... 250/553
7,538,784 B2 5/2009 Yamazaki et al.
7,719,554 B2 5/2010 Yamazaki et al.
7,719,555 B2 5/2010 Yamazaki et al.
7,733,360 B2 6/2010 Yamazaki et al.
2001/0033319 A1 * 10/2001 Suzuki ..... 347/133
2004/0036762 A1 * 2/2004 Nihei et al. ..... 347/250
2005/0068402 A1 3/2005 Tsujino et al.
2005/0094691 A1 5/2005 Yamazaki et al.
2008/0024393 A1 1/2008 Yamazaki et al.
2008/0136888 A1 6/2008 Yamazaki et al.
2008/0150849 A1 6/2008 Yamazaki et al.

(Continued)

FOREIGN PATENT DOCUMENTS

JP 59-133082 A 7/1984
JP 2005-047012 A 2/2005

(Continued)

OTHER PUBLICATIONS

Japanese Office Action dated Nov. 26, 2013, issued in corresponding Japanese Patent Application No. 2010-062989.

*Primary Examiner* — Sarah Al Hashimi
(74) *Attorney, Agent, or Firm* — Sughrue Mion, PLLC

(57) ABSTRACT

An exposure apparatus that emits light toward a latent-image bearing member configured to bear a latent image, the latent image formed on the latent-image bearing member being used in a developing process performed by a developing device. The exposure apparatus includes a first light-emitting unit including an organic electroluminescence element disposed along a main scanning direction of the latent-image bearing member, the first light-emitting unit emitting light toward the latent-image bearing member, and a second light-emitting unit disposed along the main scanning direction, the second light-emitting unit correcting an amount of light to which the latent-image bearing member is exposed in cooperation with the first light-emitting unit.

9 Claims, 9 Drawing Sheets

(56) References Cited

U.S. PATENT DOCUMENTS

| | | | | |
|---|---|---|---|---|
| 2008/0291472 | A1 | 11/2008 | Yamazaki et al. | |
| 2008/0303886 | A1* | 12/2008 | Yamazaki et al. | 347/132 |
| 2009/0115705 | A1* | 5/2009 | Miller et al. | 345/76 |

FOREIGN PATENT DOCUMENTS

| | | | |
|---|---|---|---|
| JP | 2005-104055 | A | 4/2005 |
| JP | 2005-212185 | A | 8/2005 |
| JP | 2007-069399 | A | 3/2007 |

* cited by examiner

EXPOSURE APPARATUS AND IMAGE FORMING APPARATUS

CROSS-REFERENCE TO RELATED APPLICATIONS

This application is based on and claims priority under 35 USC 119 from Japanese Patent Application No. 2010-062989 filed Mar. 18, 2010.

BACKGROUND

The present invention relates to an exposure apparatus and an image forming apparatus.

SUMMARY

According to an aspect of the invention, an exposure apparatus that emits light toward a latent-image bearing member configured to bear a latent image, the latent image formed on the latent-image bearing member being used in a developing process performed by a developing device, includes a first light-emitting unit including an organic electroluminescence element disposed along a main scanning direction of the latent-image bearing member, the first light-emitting unit emitting light toward the latent-image bearing member; and a second light-emitting unit disposed along the main scanning direction, the second light-emitting unit correcting an amount of light to which the latent-image bearing member is exposed in cooperation with the first light-emitting unit.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described with reference to the drawings.

Overall Structure of Image Forming Apparatus 10

Figure 1:
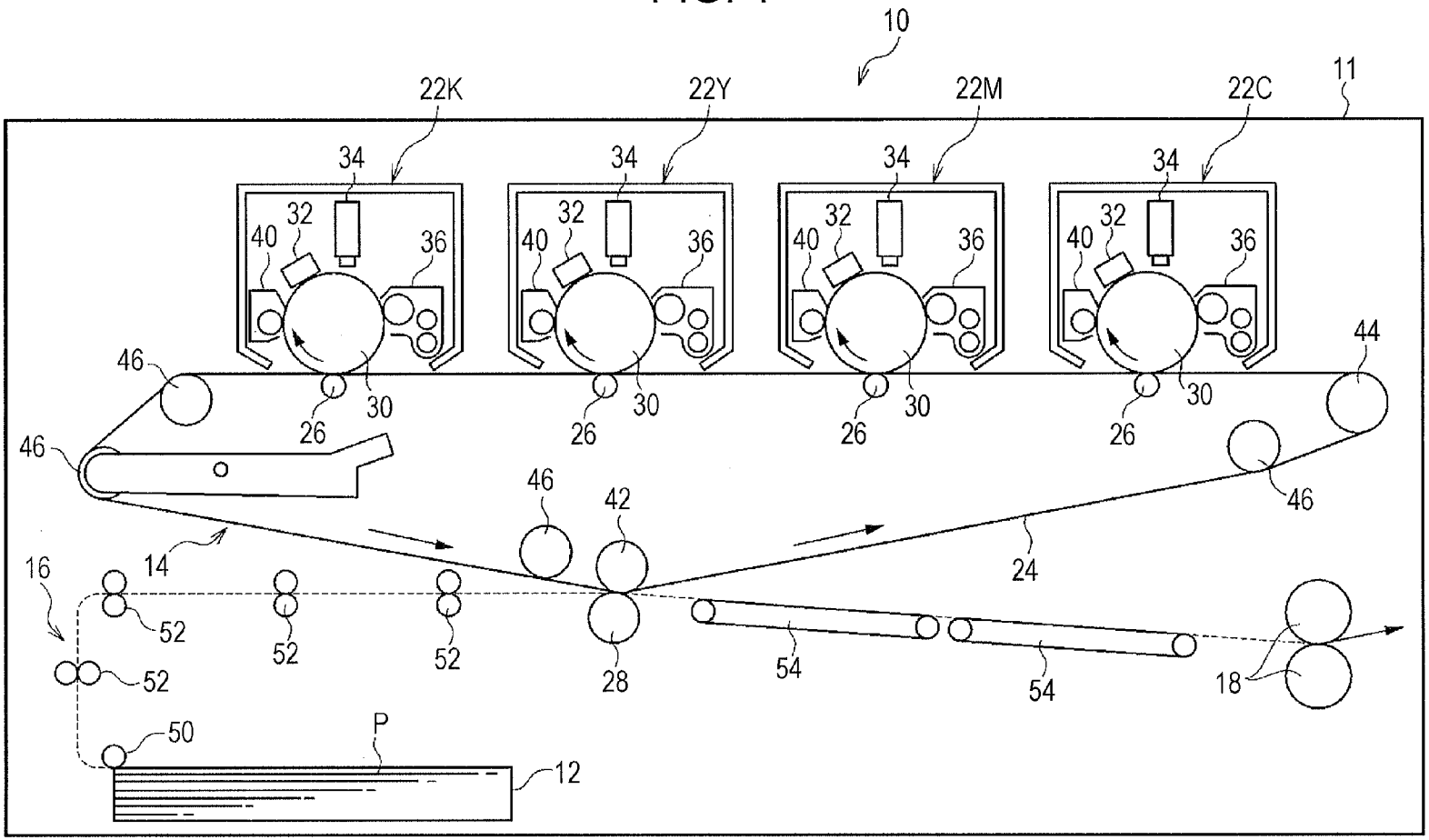
FIG. 1 is a schematic diagram illustrating the structure of an image forming apparatus including exposure heads according to a first exemplary embodiment.

First, the structure of an image forming apparatus 10 including exposure heads according to a first exemplary embodiment will be described. FIG. 1 is a schematic diagram illustrating the structure of the image forming apparatus 10 according to the present exemplary embodiment.

Referring to FIG. 1, the image forming apparatus 10 according to the present exemplary embodiment includes an apparatus housing 11 which accommodates various components; a recording-medium storage section 12 in which recording media P, such as sheets of paper, are stored; an image forming section 14 which forms toner images on the recording media P; a transport section 16 which transports the recording media P from the recording-medium storage section 12 to the image forming section 14; a fixing device 18 which fixes the toner images formed on the recording media P by the image forming section 14; and a recording-medium ejection section (not shown) to which the recording media P on which the toner images are fixed by the fixing device 18 are ejected.

The recording-medium storage section 12, the image forming section 14, the transport section 16, and the fixing device 18 are accommodated in the apparatus housing 11.

The image forming section 14 includes image forming units 22C, 22M, 22Y, and 22K that form toner images of respective colors, which are cyan (C), magenta (M), yellow (Y), and black (K); an intermediate transfer belt 24 which is an example of an intermediate transfer body and onto which the toner images formed by the image forming units 22C, 22M, 22Y, and 22K are transferred; first transfer rollers 26 which are an example of first transfer members that transfer the toner images formed by the image forming units 22C, 22M, 22Y, and 22K onto the intermediate transfer belt 24; and a second transfer roller 28 which is an example of a second transfer member that transfers the toner images on the intermediate transfer belt 24 onto a recording medium P.

Each of the image forming units 22C, 22M, 22Y, and 22K includes a photoconductor drum 30 which is an example of a latent-image bearing member configured to bear a latent image. The photoconductor drum 30 rotates in one direction (clockwise in FIG. 1).

A charging device 32, an exposure head 34, a developing device 36, and a removing device 40 are arranged around each photoconductor drum 30 in that order from an upstream side in the rotating direction of the photoconductor drum 30. The charging device 32 charges a surface of the photoconductor drum 30. The exposure head 34 is an example of an exposure apparatus that emits light toward the charged surface of the photoconductor drum 30 to form an electrostatic latent image on the surface of the photoconductor drum 30. The developing device 36 develops the electrostatic latent image formed on the surface of the photoconductor drum 30 to form a toner image. The removing device 40 removes toner that remains on the surface of the photoconductor drum 30 after the toner image has been transferred onto the intermediate transfer belt 24.

The photoconductor drum 30, the charging device 32, the exposure head 34, the developing device 36, and the removing device 40 are disposed in each of the image forming units 22C, 22M, 22Y, and 22K as a unit. The image forming units 22C, 22M, 22Y, and 22K are formed as process cartridges that are detachably attached to the apparatus housing 11 in a replaceable manner.

It is not necessary that all of the photoconductor drum 30, the charging device 32, the exposure head 34, the developing device 36, and the removing device 40 be integrated as a unit. For example, at least one of the photoconductor drum 30, the charging device 32, and the developing device 36 may be disposed together with the exposure head 34 in each of the image forming units 22C, 22M, 22Y, and 22K as a unit.

The intermediate transfer belt 24 is retained by a counter roller 42 that is opposed to the second transfer roller 28, a driving roller 44, and plural retaining rollers 46, and rotates in one direction (counterclockwise in FIG. 1) while being in contact with the photoconductor drums 30.

The first transfer rollers 26 are opposed to the respective photoconductor drums 30 with the intermediate transfer belt 24 provided therebetween. First transfer positions at which the toner images on the photoconductor drums 30 are transferred onto the intermediate transfer belt 24 are defined between the first transfer rollers 26 and the respective photoconductor drums 30. The first transfer positions are located between the developing devices 36 and the respective removing devices 40. The first transfer rollers 26 transfer the toner images on the surfaces of the photoconductor drums 30 onto the intermediate transfer belt 24 by applying pressure and electrostatic force to the intermediate transfer belt 24 at the first transfer positions.

The second transfer roller 28 is opposed to the counter roller 42 with the intermediate transfer belt 24 provided therebetween. A second transfer position at which the toner images on the intermediate transfer belt 24 are transferred onto the recording medium P is defined between the second transfer roller 28 and the counter roller 42. The second transfer roller 28 transfers the toner images on the surface of the intermediate transfer belt 24 onto the recording medium P by applying pressure and electrostatic force to the recording medium P at the second transfer position.

The transport section 16 includes a feed roller 50 that feeds each of the recording media P stored in the recording-medium storage section 12 and plural pairs of transport rollers 52 that transport the recording medium P fed by the feed roller 50 to the second transfer position.

The fixing device 18 is disposed downstream of the second transfer position in a transporting direction, and fixes the toner images that have been transferred onto the recording medium P at the second transfer position.

Transport belts 54, which are an example of transporting members that transport the recording medium P to the fixing device 18, are disposed downstream of the second transfer position in the transporting direction and upstream of the fixing device 18 in the transporting direction.

In the image forming apparatus 10 according to the present exemplary embodiment having the above-described structure, first, the recording medium P fed from the recording-medium storage section 12 is transported to the second transfer position by the pairs of transport rollers 52.

The toner images of respective colors formed by the image forming units 22C, 22M, 22Y, and 22K are superposed on the intermediate transfer belt 24 so as to form a color image. The color image formed on the intermediate transfer belt 24 is transferred onto the recording medium P that has been transported to the second transfer position.

The recording medium P having the toner images transferred thereon is transported to the fixing device 18, and the toner images on the recording medium P are fixed by the fixing device 18. The recording medium P having the toner images fixed thereon is ejected to the recording-medium ejection section (not shown). Thus, an image forming operation is performed.

The structure of the image forming apparatus is not limited to the above-described structure, and the image forming apparatus may have various types of structures. For example, the image forming apparatus may be of a direct-transferring type in which the intermediate transfer body is omitted.

Structure of Exposure Heads 34

Figure 2:
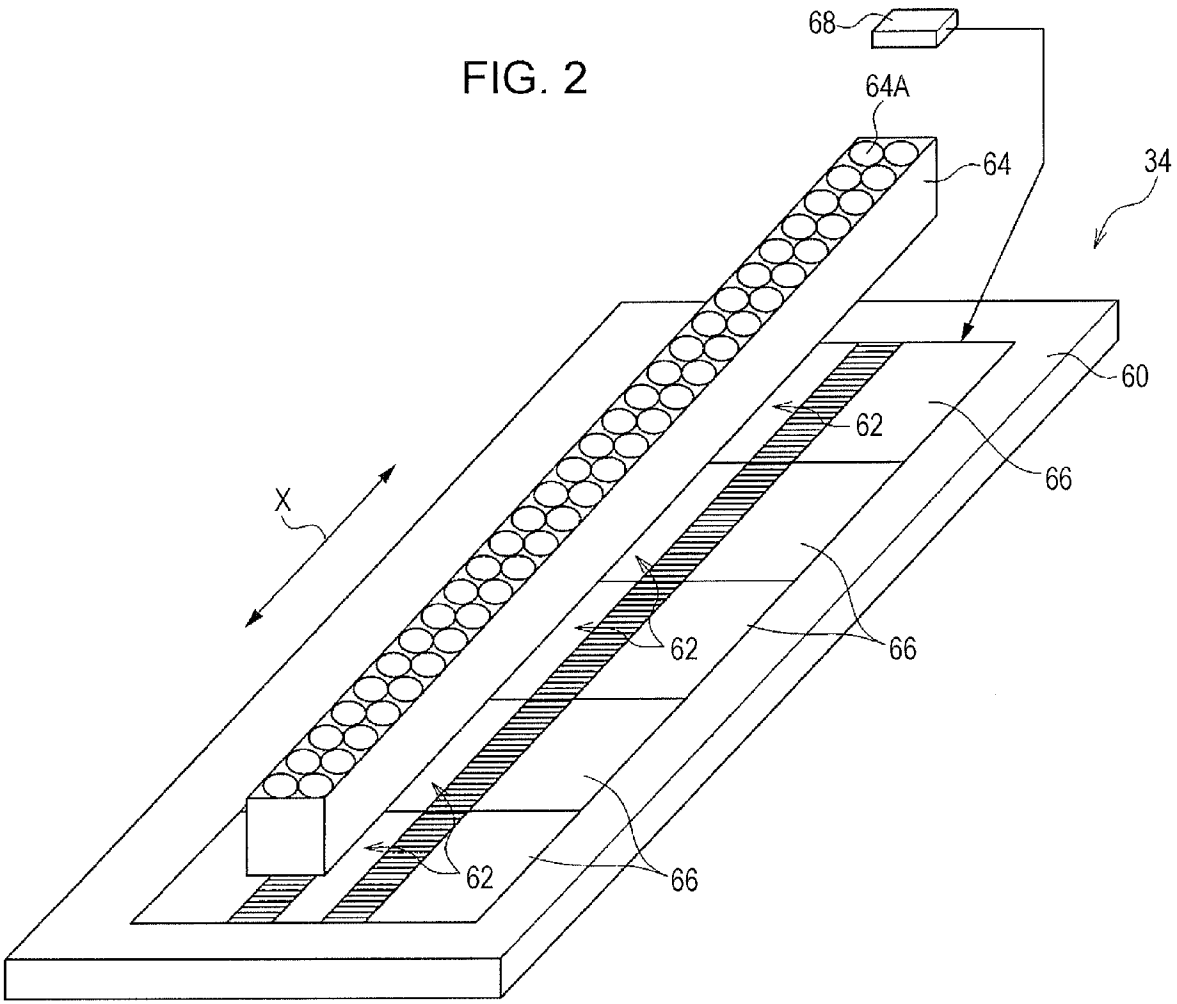
FIG. 2 is a schematic diagram illustrating the structure of each exposure head according to the first exemplary embodiment.
Figure 3:
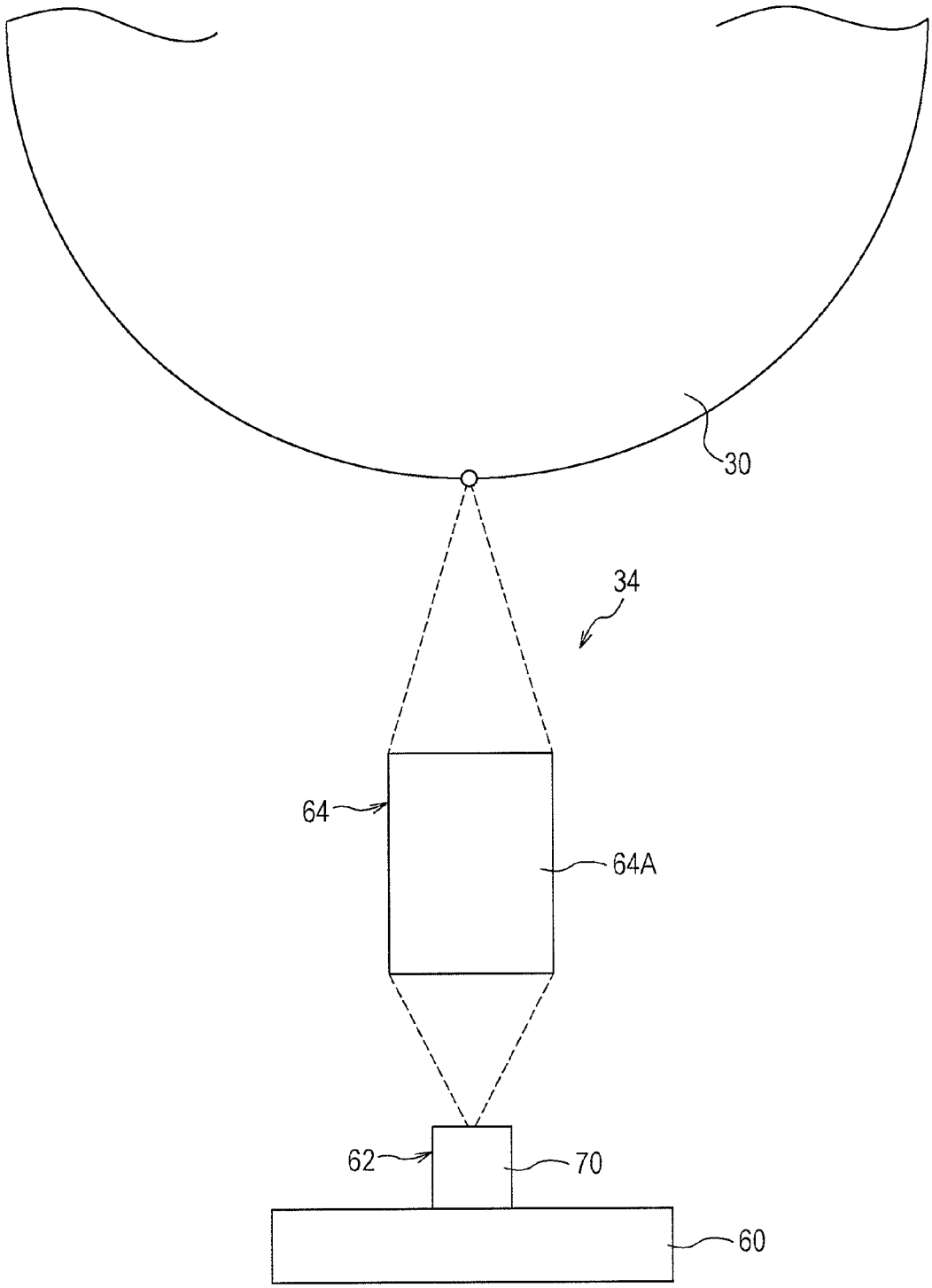
FIG. 3 is a schematic diagram illustrating the state in which light emitted from the exposure head according to the first exemplary embodiment is focused on a photoconductor drum.
Figure 4:
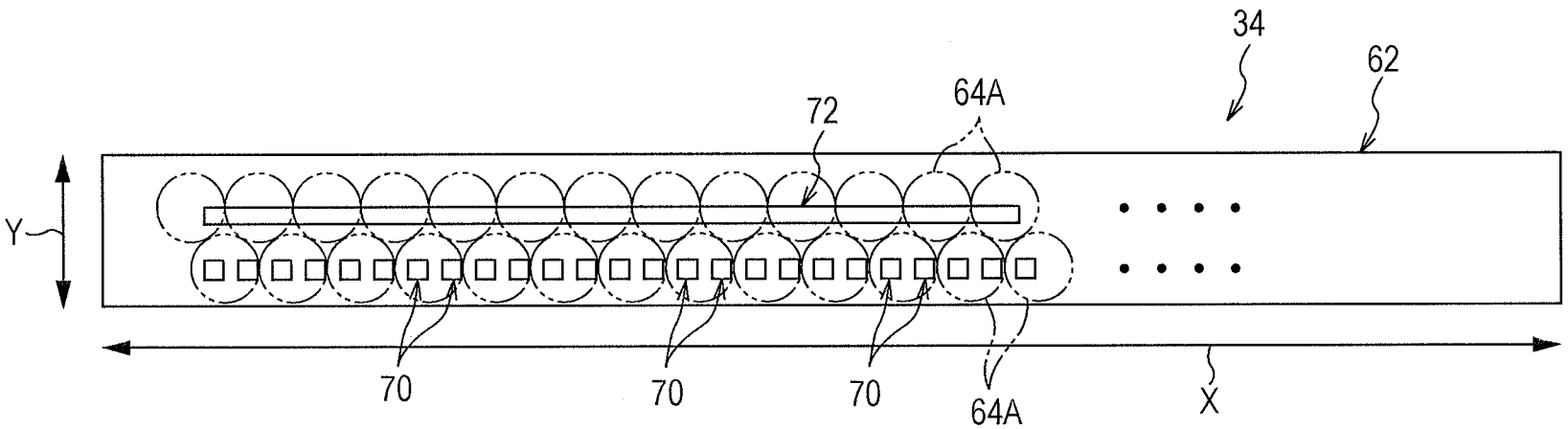
FIG. 4 is a schematic plan view illustrating the structure of the exposure head according to the first exemplary embodiment.

The structure of the exposure heads 34 will now be described. FIGS. 2, 3, and 4 are schematic diagrams illustrating the structure of each exposure head 34 according to the first exemplary embodiment.

As illustrated in FIGS. 2 and 3, each exposure head 34 includes a substrate 60 having an oblong shape that extends in a main scanning direction X along an axial direction of the photoconductor drum 30; organic electroluminescence (EL) device arrays 62 which are an example of light-emitting device arrays; and a selfoc (registered trademark) lens array 64 which is an example of an imaging-element array that collects light generated by the organic EL device arrays 62 and focuses the light on an irradiation surface, that is, a surface of the photoconductor drum 30.

The substrate 60 is formed of an insulating substrate, such as a glass substrate or a resin substrate.

As illustrated in FIG. 4, each organic EL device array 62 includes plural first organic EL devices 70 for a main exposure light source and a second organic EL device 72 for an auxiliary exposure light source. The first organic EL devices 70 are an example of first light-emitting units and are arranged in the main scanning direction X. The second organic EL device 72 is an example of a second light-emitting unit that extends along a single line at one side of the first organic EL devices 70 in a sub-scanning direction Y (direction perpendicular to the main scanning direction X). The organic EL devices are an example of organic electroluminescence elements.

The first organic EL devices 70, the number of which corresponds to the number of pixels (number of dots), are arranged on the substrate 60. The first organic EL devices 70 have a substantially square shape in a plan view, and are arranged with substantially constant intervals therebetween along the main scanning direction X. The second organic EL device 72 has an oblong (band-like) shape and is formed on the substrate 60 so as to extend in the main scanning direction X at a position next to the first organic EL devices 70. The second organic EL device 72 has a rectangular shape including long sides that extend in the main scanning direction X. In the present exemplary embodiment, a single second organic EL device 72 is provided.

An amount of light emitted from the first organic EL devices 70 is set to an amount of light necessary to form an electrostatic latent image by exposing the photoconductor drum 30 that has been charged by the charging device 32 (see FIG. 1) to light. The second organic EL device 72 compensates for the amount of light from the first organic EL devices 70 when the amount of light from the first organic EL devices 70 is reduced as a result of degradation of the first organic EL devices 70. An amount of light emitted from the second organic EL device 72 is set to be smaller than the amount of light emitted from the first organic EL devices 70.

The second organic EL device 72 extends substantially parallel to the line of the first organic EL devices 70 arranged along the main scanning direction X. A single second organic EL device 72 serves to correct the amount of light from the plural first organic EL devices 70.

As illustrated in FIG. 2, plural driver ICs 66, which are an example of driving circuits that drive the first organic EL devices 70 and the second organic EL device 72, are provided on the substrate 60. Each driver IC 66 individually drives the first organic EL devices 70 and the second organic EL device 72.

Plural rod lenses 64A, which are an example of imaging elements, are arranged in the selfoc lens array 64. The selfoc lens array 64 is disposed at a light emission side of the first organic EL devices 70 and the second organic EL device 72.

In the selfoc lens array 64, the rod lenses 64A are two-dimensionally arranged such that erect equal-magnification imaging may be performed by plural rod lenses 64A for the first organic EL devices 70 that correspond to each dot. Therefore, the light from each of the first organic EL devices 70 and the second organic EL device 72 is focused on the surface of the photoconductor drum 30 through the corresponding plural rod lenses 64A. Thus, the electrostatic latent image is formed by exposing the photoconductor drum 30 with the light emitted from the first organic EL devices 70 and the second organic EL device 72.

The exposure head 34 includes a sensor 68 which is an example of a detector that detects an amount of light emitted from the first organic EL devices 70. A detection signal output from the sensor 68 is input to the driver ICs 66, and each driver IC 66 controls the amount of light emitted from the second organic EL device 72 in accordance with a reduction in the amount of light emitted from the first organic EL devices 70.

Figure 6:
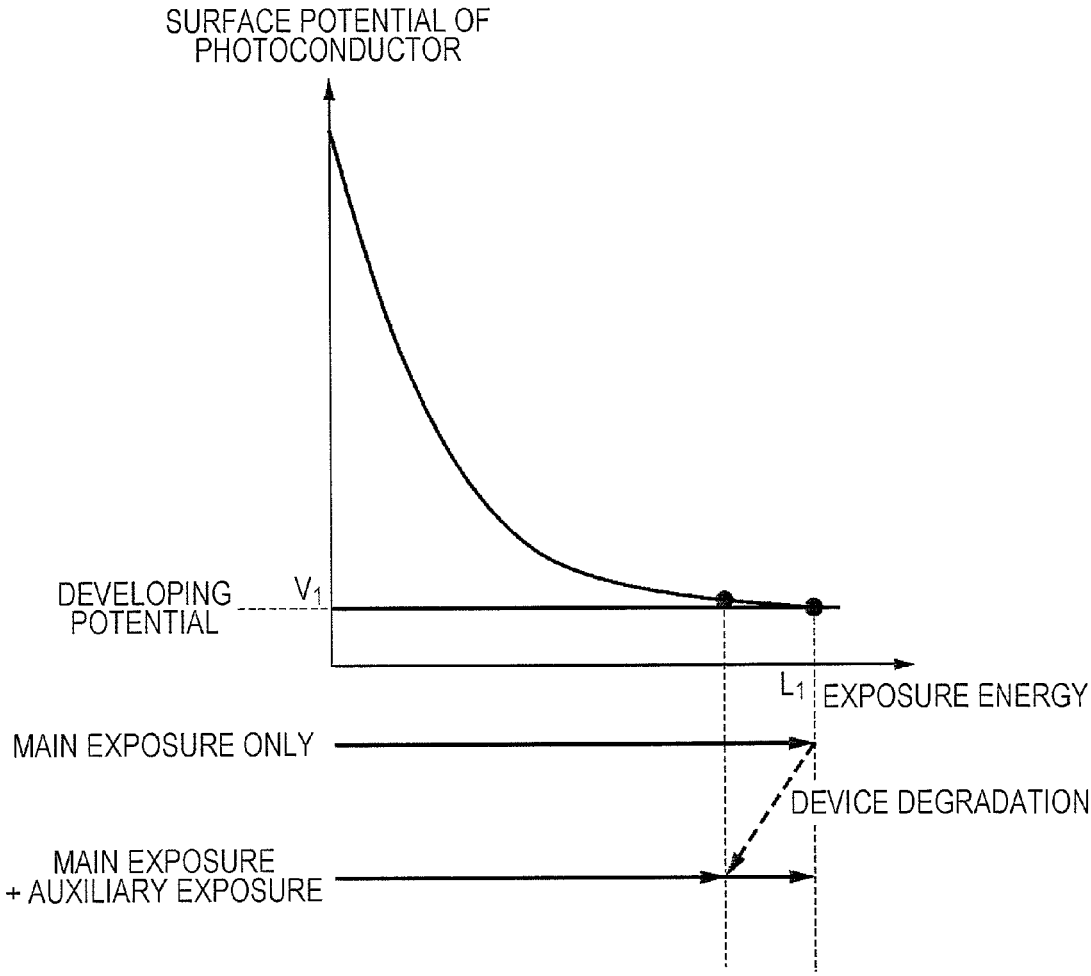
FIG. 6 is a graph illustrating an example of the relationship between the surface potential of the photoconductor drum and the exposure energy provided by the exposure head.

FIG. 6 is a graph illustrating the relationship between the exposure energy (amount of light) from the exposure head 34 and the surface potential of the photoconductor drum 30. As is clear from this graph, if the exposure energy provided by the first organic EL devices 70 is reduced as a result of degradation of the first organic EL devices 70, there is a possibility that the surface potential of the photoconductor drum 30 cannot be reduced to a predetermined developing potential in the exposure process. Therefore, in the present exemplary embodiment, if the amount of light from the first organic EL devices 70 is reduced, the amount of light from the second organic EL device 72 is controlled such that the surface potential of the photoconductor drum 30 may be reduced to the predetermined developing potential in the exposure process. More specifically, in accordance with the amount of light from the first organic EL devices 70 that is detected by the sensor 68, the second organic EL device 72 is controlled such that the second organic EL device 72 emits light so as to compensate for (correct) the reduction in the amount of light from the first organic EL devices 70. As a result, the surface potential of the photoconductor drum 30 may be changed to the predetermined developing potential in the exposure process.

An optical lens assembled to the first organic EL devices 70 and the second organic EL device 72 is not limited to the selfoc lens array 64, and a cylindrical lens may be used instead. Alternatively, a microlens may be bonded to each of the first organic EL devices 70.

Structure of First Organic EL Devices 70 and Second Organic EL Device 72

The structure of each of the first organic EL devices 70 and the second organic EL device 72 will now be described.

Each of the first organic EL devices 70 and the second organic EL device 72 may be either of a bottom-emission-type organic EL device in which light from a light-emitting layer 84, which will be described below, is emitted from a side of the substrate 60 and a top-emission-type organic EL device in which light from a light-emitting layer is emitted from a side opposite to the substrate 60. In the present exemplary embodiment, a structure in which bottom-emission-type organic EL devices are used will be described. The organic EL devices included in the exposure head 34 are not limited to the bottom-emission-type organic EL devices, and may instead be top-emission-type organic EL devices.

Structure of Organic EL Devices

Figure 5:
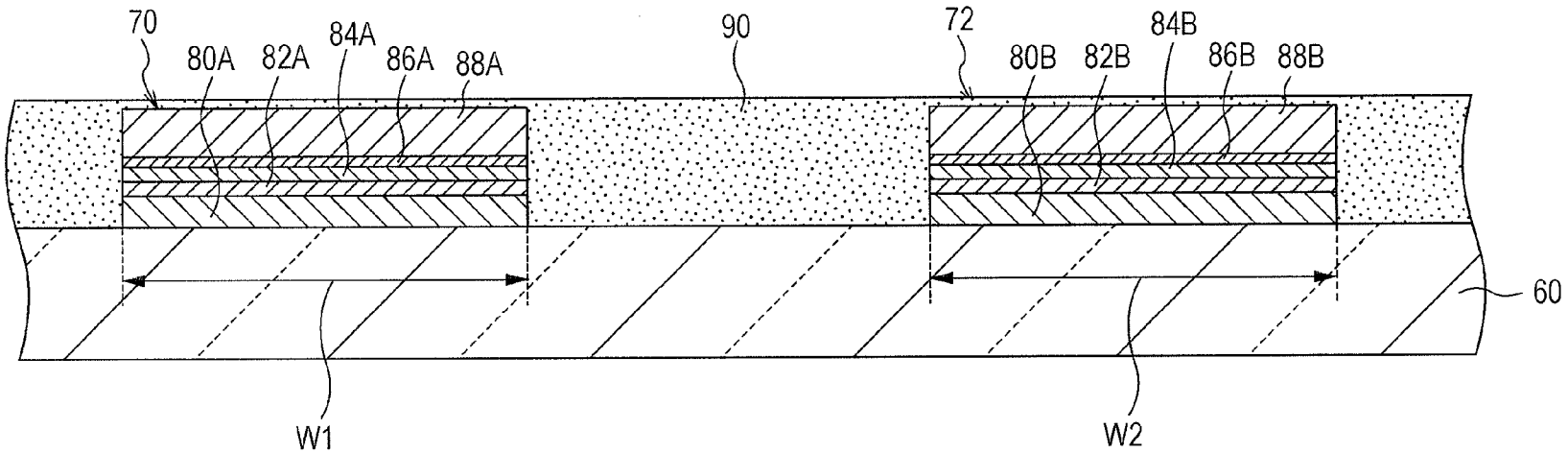
FIG. 5 is a schematic diagram illustrating the structure of a first organic EL device and a second organic EL device of a bottom emission type.

First, the structures of each first organic EL device 70 and the second organic EL device 72 will be described. FIG. 5 illustrates the structure of each first organic EL device 70 and the second organic EL device 72 of the bottom emission type. FIG. 5 is a vertical sectional view of the exposure head 34 including the first organic EL devices 70 and the second organic EL device 72 illustrated in FIG. 4 taken along the sub-scanning direction Y (direction perpendicular to the main scanning direction X).

As illustrated in FIG. 5, each first organic EL device 70 includes an anode 80A formed on a surface of the substrate 60 that is optically transparent, a hole injection layer 82A formed on a surface of the anode 80A; a light-emitting layer 84A that is formed on a surface of the hole injection layer 82A and that defines a light-emitting area; a cathode 86A that is formed on a surface of the light-emitting layer 84A and that injects electrons; and a reflective layer 88A formed on a surface of the cathode 86A. A sealing layer 90 is formed on a surface of the reflective layer 88A such that the sealing layer 90 covers the sides of the anode 80A, the hole injection layer 82A, the light-emitting layer 84A, the cathode 86A, and the reflective layer 88A. Thus, each first organic EL device 70 includes the anode 80A, the hole injection layer 82A, the light-emitting layer 84A, the cathode 86A, the reflective layer 88A, and the sealing layer 90, which are stacked in that order on the substrate 60.

The first organic EL devices 70 (see FIG. 4) are provided with respective anodes 80A that are divided from each other, so that currents supplied to the light-emitting areas are controlled individually. The anodes 80A have a rectangular shape that corresponds to the shape of the light-emitting areas of the first organic EL devices 70.

The cathode 86A is band-shaped and extends in the main scanning direction X so as to form a pair with each of the multiple anodes 80A. The cathode 86A is provided in common for all of the light-emitting areas in the first organic EL devices 70.

The second organic EL device 72 includes an anode 80B, a hole injection layer 82B, a light-emitting layer 84B, a cathode 86B, a reflective layer 88B, and the sealing layer 90, which are stacked in that order on the substrate 60. The anode 80B, the hole injection layer 82B, the light-emitting layer 84B, the cathode 86B, and the reflective layer 88B have an oblong shape that extends in the main scanning direction X in a plan view.

In the present exemplary embodiment, the anodes 80A and 80B, the hole injection layers 82A and 82B, the light-emitting layers 84A and 84B, the cathodes 86A and 86B, and the reflective layers 88A and 88B included in the first organic EL devices 70 and the second organic EL device 72, respectively, are formed of the same materials. In the following description, components common to the first organic EL devices 70 and the second organic EL device 72 may be denoted by reference numerals without A or B at the end.

The anode 80 is optically transparent and transmits light, so that light from the light-emitting layer 84 may be emitted from the side of the substrate 60. The anode 80 is made of, for example, a conductive metal oxide, such as $SnO_2$, $In_2O_3$, indium-tin-oxide (ITO), or IZO:Al (IZO: indium-zinc-oxide). However, the material of the anode 80 is not limited to the above-mentioned materials. The thickness of the anode 80 is, for example, 100 nm. However, the thickness of the anode 80 is not limited to this.

Holes are injected into the hole injection layer 82 from the anode 80 when a voltage is applied between the cathode 86 and the anode 80. The hole injection layer 82 is made of, for example, a low-molecular material such as a phthalocyanine-based material (e.g., CuPc) or an indanthrene-based compound, or a high-molecular material such as 4,4',4"-tris(3-methylphenylphenylamino)triphenylamine (MTDATA), polyaniline, or polyethylene dioxythiophene/polystyrene sulfonate (PEDOT/PSS). However, the material of the hole injection layer 82 is not limited to the above-mentioned materials. The thickness of the hole injection layer 82 is, for example, 30 nm. However, the thickness of the hole injection layer 82 is not limited to this. A hole transport layer may be provided between the hole injection layer 82 and the anode 80 to increase the hole injection efficiency.

Electrons are injected into the light-emitting layer 84 from the cathode 86 when a voltage is applied between the cathode 86 and the anode 80. The holes injected into the hole injection layer 82 are moved to the light-emitting layer 84, and are combined with the electrons. As a result, the light-emitting layer 84 emits light.

The light-emitting layer 84 may be formed of, for example, a chelate-type organometallic complex, a polynuclear or condensed aromatic ring compound, a perylene derivative, a coumarine derivative, a styrylarylene derivative, a silole derivative, an oxazole derivative, an oxathiazole derivative, an oxadiazole derivative, a polyparaphenylene derivative, a polyparaphenylene vinylene derivative, a polythiophene derivative, or a polyacetylene derivative. However, the material of the light-emitting layer 84 is not limited to the above-mentioned materials. The thickness of the light-emitting layer 84 is, for example, 50 nm. However, the thickness of the light-emitting layer 84 is not limited to this.

It is not necessary that the cathode 86 be optically transparent and transmit light. This is because the light from the light-emitting layer 84 is emitted through the substrate 60 in each first organic EL device 70. In the present exemplary embodiment, the cathode 86 is formed of a single layer. However, the cathode 86 may instead be formed of plural layers.

The cathode 86 is made of, for example, Ca. However, the material of the cathode 86 is not limited to this. The material of the cathode 86 may be, for example, a conductive metal oxide such as $SnO_2$, $In_2O_3$, ITO, or IZO:Al. The thickness of the cathode 86 is, for example, 30 nm. However, the thickness of the cathode 86 is not limited to this. An electron injection layer or an electron transport layer may be provided between the cathode 86 and the light-emitting layer 84 to increase the electron injection efficiency.

The reflective layer 88 reflects the light from the light-emitting layer 84 toward the light-emitting layer 84. The reflective layer 88 may be formed of, for example, Al, Ag, Mo, W, Ni, or Cr. However, the material of the reflective layer 88 is not limited to the above-mentioned materials. The thickness of the reflective layer 88 is, for example, 150 nm. However, the thickness of the reflective layer 88 is not limited to this.

A width W1 (in both the main scanning direction X and the sub-scanning direction Y) of the light-emitting area in each first organic EL device 70 is determined in accordance with the resolution of the exposure head 34, and is, for example, about 20 μm for a resolution of 600 dpi and about 10 μm for a resolution of 1,200 dpi. A width W2 (in the sub-scanning direction Y) of the light-emitting area in the second organic EL device 72 is, for example, about 20 μm.

The operation of the exposure head 34 according to the present exemplary embodiment will now be described.

In the exposure head 34, when the photoconductor drum 30 is exposed to the light from the first organic EL devices 70 to form the electrostatic latent image, the amount of light emitted from the first organic EL devices 70 is detected by the sensor 68. In other words, the amount of light emitted from the first organic EL devices 70 is monitored during the exposure process performed by the exposure head 34.

As illustrated in FIG. 6, when the exposure energy (amount of light) is reduced to a value below a predetermined value $L_1$ as a result of degradation of the first organic EL devices 70, the second organic EL device 72 is caused to emit light so as to correct the exposure energy provided by the first organic EL devices 70. Thus, the exposure energy is corrected to the predetermined exposure energy $L_1$ by combining the light emitted from the first organic EL devices 70 and the light emitted from the second organic EL device 72. As a result, the potential of the photoconductor drum 30 may be set to a predetermined developing potential $V_1$ by exposing the photoconductor drum 30 with the light emitted from the first organic EL devices 70 and the second organic EL device 72.

In the above-described exposure head 34, the amount of light from the plural first organic EL devices 70 is corrected by a single second organic EL device 72.

In the exposure head 34 according to a modification of the present exemplary embodiment, the second organic EL device 72 is caused to emit light from the initial stage. The amount of light emitted from the second organic EL device 72 is adjusted such that the potential of the photoconductor drum 30 is within a range in which developing is not performed by the developing device 36. For example, reduction in the amount of light from the first organic EL devices 70 caused by degradation thereof is predicted in advance, and the second organic EL device 72 is caused to emit a constant or substantially constant amount of light so as to compensate for the reduction in the amount of light from the first organic EL devices 70.

Figure 7:
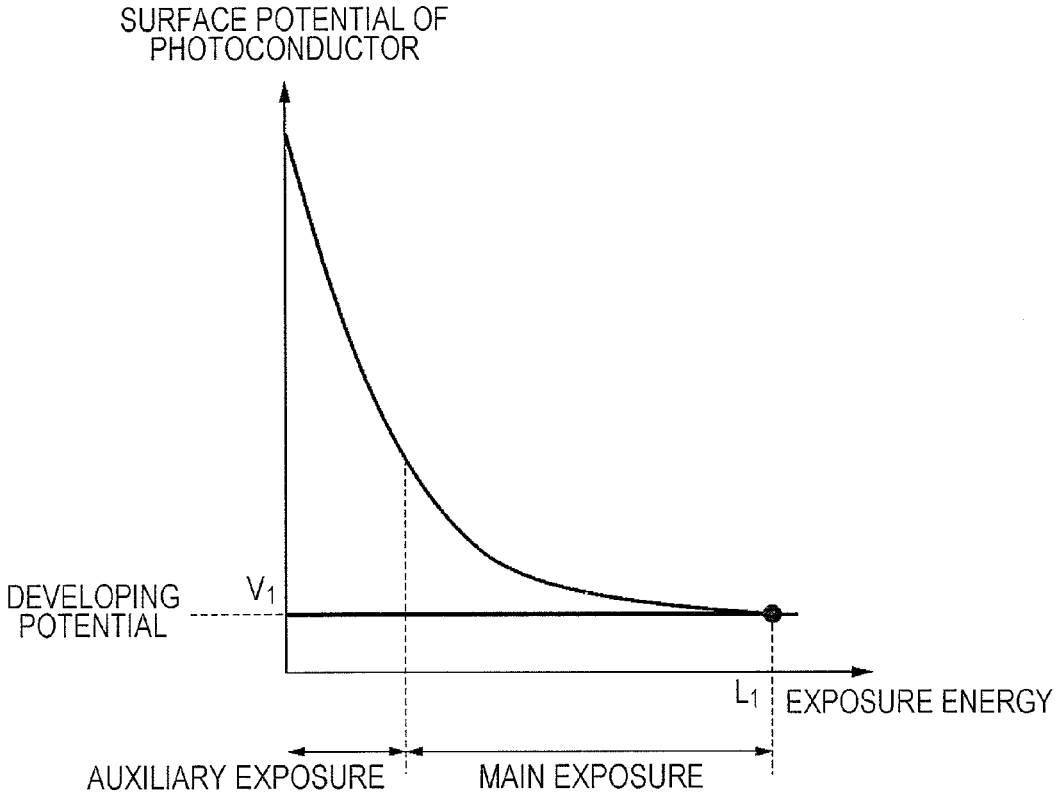
FIG. 7 is a graph illustrating another example of the relationship between the surface potential of the photoconductor drum and the exposure energy provided by the exposure head.

More specifically, as illustrated in FIG. 7, a substantially constant amount of light may be emitted from the second organic EL device 72 from the initial stage, and the potential of the photoconductor drum 30 may be controlled at the predetermined developing potential $V_1$ by adjusting the amount of light emitted from the first organic EL devices 70. In this case, it is not necessary to control the amount of light from the second organic EL device 72, and the feedback to the driver ICs 66 for correcting the amount of light may be simplified.

The present invention is not limited to the above-described exemplary embodiment, and various modifications, alterations, and improvements may be made.

Next, an exposure head according to a second exemplary embodiment will be described with reference to FIG. 8.

Components similar to those in the above-described first exemplary embodiment are denoted by the same reference numerals, and explanations thereof are thus omitted.

Figure 8:
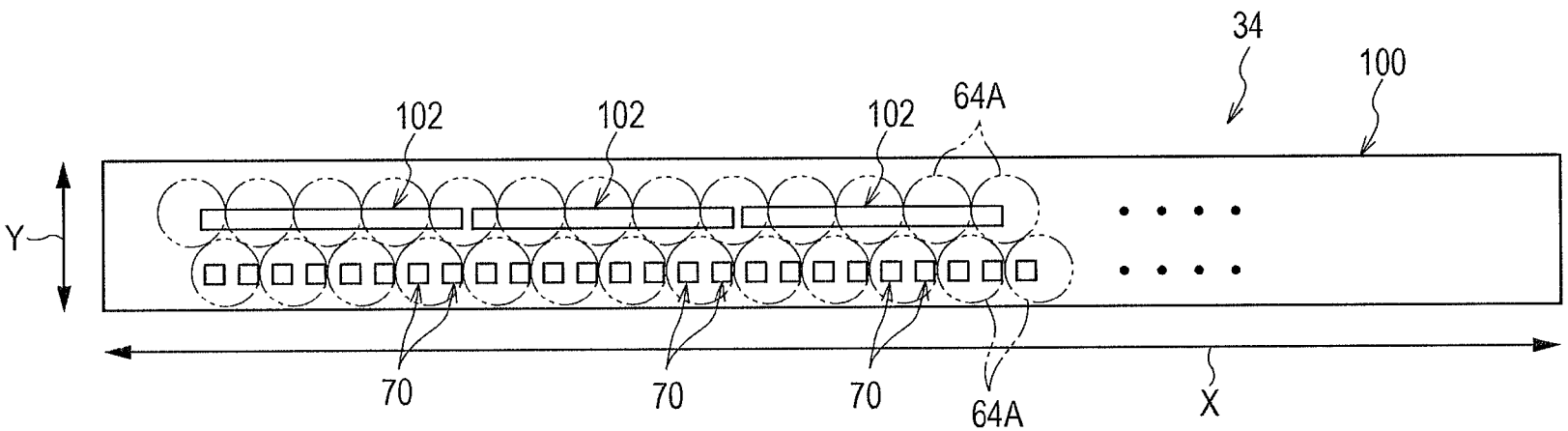
FIG. 8 is a schematic plan view illustrating the structure of an exposure head according to a second exemplary embodiment.

As illustrated in FIG. 8, an organic EL device array 100 included in the exposure head 34 includes plural second organic EL devices 102 which are an example of second light-emitting units that are divided from each other in the main scanning direction X. The second organic EL devices 102 are disposed at one side of first organic EL devices 70, which are arranged along the main scanning direction X, in the sub-scanning direction Y. More specifically, the second organic EL devices 102 are rectangular elements whose length in the main scanning direction X is smaller than that of the second organic EL device 72 (see FIG. 4) according to the first exemplary embodiment. Each of the second organic EL devices 102 extends substantially parallel to the line of the first organic EL devices 70 arranged along the main scanning direction X. Each of the second organic EL devices 102 serves to correct the amount of light from a smaller number of first organic EL devices 70 than that in the first exemplary embodiment.

In the above-described organic EL device array 100, the plural second organic EL devices 102 are controlled such that only the second organic EL devices 102 needed to correct the amount of light from the first organic EL devices 70 are caused to emit light.

Next, an exposure head according to a third exemplary embodiment will be described with reference to FIG. 9.

Components similar to those in the above-described first and second exemplary embodiments are denoted by the same reference numerals, and explanations thereof are thus omitted.

Figure 9:
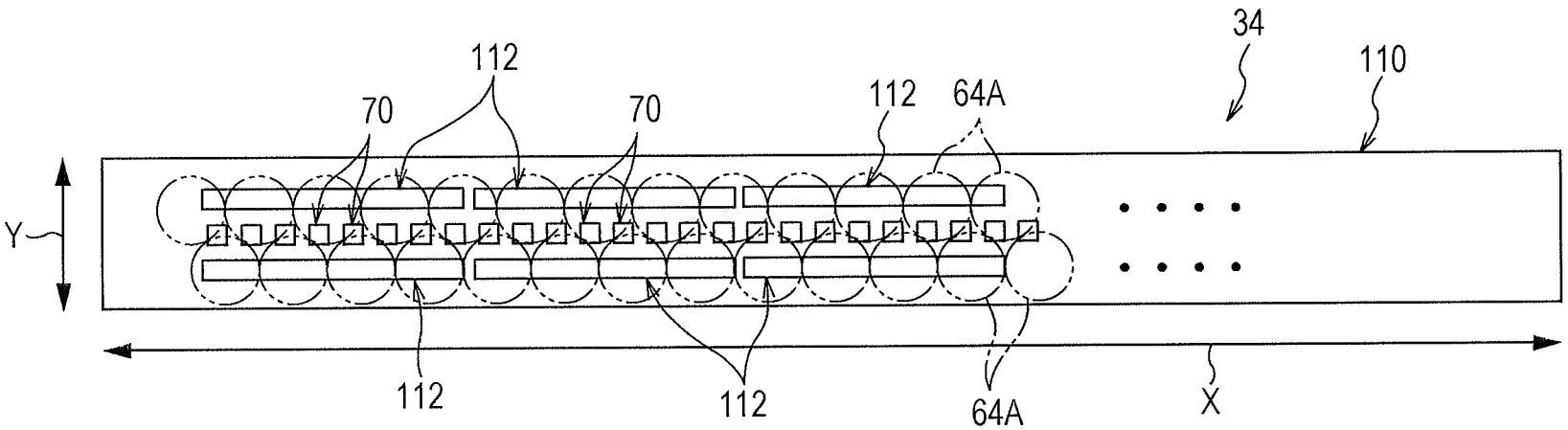
FIG. 9 is a schematic plan view illustrating the structure of an exposure head according to a third exemplary embodiment.

As illustrated in FIG. 9, an organic EL device array 110 included in the exposure head 34 includes plural second organic EL devices 112 which are an example of second light-emitting units that are divided from each other in the main scanning direction X. The second organic EL devices 112 are disposed at either side of first organic EL devices 70, which are arranged along the main scanning direction X, in the sub-scanning direction Y. More specifically, the second organic EL devices 112 are oblong rectangular elements whose length in the main scanning direction X is smaller than that of the second organic EL device 72 (see FIG. 4) according to the first exemplary embodiment. Each of the second organic EL devices 112 extends substantially parallel to the line of the first organic EL devices 70 arranged along the main scanning direction X.

In the above-described organic EL device array 110, each of the second organic EL devices 112 at both sides of the first organic EL devices 70 in the sub-scanning direction Y compensates for the amount of light from a smaller number of first organic EL devices 70 than that in the first exemplary embodiment.

The shapes and arrangements of the first organic EL devices and the second organic EL devices are not limited to those in the first to third exemplary embodiments, and may be changed to other shapes and arrangements.

In addition, although organic EL devices are used as the second light-emitting units in the exposure heads according to the above-described first to third exemplary embodiments, the second light-emitting units may instead be other types of light-emitting units, such as LEDs.

EXAMPLES

Next, examples of exposure heads will be described.

Examples 1 and 2

In Examples 1 and 2, referring to FIGS. 4 and 5, anodes 80A for the main exposure light source are formed on a glass substrate, which serves as the substrate 60, using indium-tin-oxide (ITO). The anodes 80A are patterned such that the anodes 80A are 20-μm wide and are arranged at a pitch of 20-μm. In addition, an anode 80B for the auxiliary exposure light source is formed at one side of the anodes 80A for the main exposure light source in the sub-scanning direction Y. The anode 80B is patterned such that the anode 80B is 20-μm wide and is line-shaped. Next, polyethylene dioxythiophene/polystyrene sulfonate (PEDOT/PSS) is applied to a uniform thickness of 10 nm by spin coating to form the hole injection layers 82A and 82B. Next, the light-emitting layers 84A and 84B are formed by preparing 1 wt % solution of a light emitting material represented by Chemical Formula (I) given below and applying the solution to a thickness of 80 nm by spin coating. Then, the cathodes 86A and 86B made of Ca and the reflective layers 88A and 88B made of Al are successively formed by vapor deposition using a mask having a 20-μm-wide opening that is perpendicular to the anodes 80A for the main exposure light source and a mask having a 40-μm-wide opening that covers the anode 80B for the auxiliary exposure light source. Thus, the plural first organic EL devices 70 arranged on the substrate 60 in the main scanning direction X and the line-shaped second organic EL device 72 that is disposed next to the first organic EL devices 70 are formed.

(1)

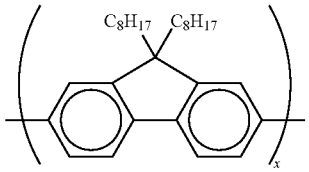

Examples 3 and 4

In Examples 3 and 4, referring to FIGS. 8 and 5, anodes 80A for the main exposure light source are formed on a glass substrate, which serves as the substrate 60, using indium-tin-oxide (ITO). The anodes 80A are patterned such that the anodes 80A are 20-μm wide and are arranged at a pitch of 20-μm. In addition, plural anodes 80B for the auxiliary exposure light source are formed at one side of the anodes 80A for the main exposure light source in the sub-scanning direction Y. The anodes 80B are patterned such that the anodes 80B are 20-μm wide and are line-shaped. Next, polyethylene dioxythiophene/polystyrene sulfonate (PEDOT/PSS) is applied to a uniform thickness of 10 nm by spin coating to form the hole injection layers 82A and 82B. Next, the light-emitting layers 84A and 84B are formed by preparing 1 wt % solution of a light emitting material represented by Chemical Formula (1) given below and applying the solution to a thickness of 80 nm by spin coating. Then, the cathodes 86A and 86B made of Ca and the reflective layers 88A and 88B made of Al are successively formed by vapor deposition using a mask having a 20-μm-wide opening that is perpendicular to the anodes 80A for the main exposure light source and a mask having 40-μm-wide openings that individually cover the anodes 80B for the auxiliary exposure light source. Thus, the plural first organic EL devices 70 arranged on the substrate 60 in the main scanning direction X and the plural second organic EL devices 102 that are disposed next to the first organic EL devices 70 are formed.

Comparative Example 1

Anodes 80A for the main exposure light source are formed on a glass substrate, which serves as the substrate 60, using indium-tin-oxide (ITO) (see the first organic EL device 70 in FIG. 5). The anodes 80A are patterned such that the anodes 80A are 20-μm wide and are arranged at a pitch of 20-μm. Next, polyethylene dioxythiophene/polystyrene sulfonate (PEDOT/PSS) is applied to a uniform thickness of 10 nm by spin coating to form the hole injection layer 82A. Next, the light-emitting layer 84A is formed by preparing 1 wt % solution of a light emitting material represented by Chemical Formula (1) given below and applying the solution to a thickness of 80 nm by spin coating. Then, the cathode 86A made of Ca and the reflective layer 88A made of Al are successively formed by vapor deposition using a mask having a 20-μm wide opening. Thus, the plural first organic EL devices 70 arranged on the substrate 60 in the main scanning direction X are formed. In Comparative Example 1, no second organic EL device is provided.

Evaluation of Exposure Heads

The result of evaluation of the exposure heads of Examples 1 to 4 and Comparative Example 1 will be described.

In this evaluation, lives of the exposure light sources in the exposure heads of Examples 1 to 4 and Comparative Example 1 in the case where the amount of light is maintained constant (6,000 cd/m$^2$) are evaluated. With regard to the exposure method, in Examples 1 and 3, the amount of light from the first organic EL devices 70 is detected by the sensor 68, and reduction in the amount of light is compensated for by causing the second organic EL devices 72 and 102 to emit light. In Examples 2 and 4, the second organic EL devices 72 and 102 are caused to emit light from the initial stage. The amount of light emitted from the second organic EL devices 72 and 102 is set to a substantially constant amount within a range in which developing is not performed by the developing device, and the amount of light emitted from the first organic EL devices 70 is adjusted. The lives of the exposure light sources are evaluated by measuring the brightness of the exposure light sources while causing the exposure light sources to continuously emit light and determining the exposure time (h) for which a certain brightness is maintained. The evaluation is repeated five times, and the average value is calculated. Table 1 shows the result of the evaluation.

TABLE 1

| | Life (h) for which certain brightness is maintained |
|---|---|
| Example 1 | 55 |
| Example 2 | 83 |
| Example 3 | 70 |
| Example 4 | 73 |
| Comparative Example 1 | 8 |

As is clear from Table 1, the lives (h) of the exposure heads of Examples 1 to 4 are longer than that of the exposure head of Comparative Example 1. In addition, the lives (h) of the exposure heads of Examples 2 and 4 are longer than those of the exposure heads of Examples 1 and 3 since the amount of light emitted from the first organic EL devices 70 is set to a relatively small amount from the initial stage.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An exposure apparatus that emits light toward a latent-image bearing member configured to bear a latent image, the latent image formed on the latent-image bearing member being used in a developing process performed by a developing device, the exposure apparatus comprising:

a first light-emitting unit including an organic electroluminescence element disposed along a main scanning direction of the latent-image bearing member, the first light-emitting unit emitting light toward the latent-image bearing member; and a second light-emitting unit disposed along the main scanning direction, the second light-emitting unit correcting an amount of light to which the latent-image bearing member is exposed by emitting light simultaneously with the first light-emitting unit, wherein the exposure apparatus adjusts an amount of light emitted from the second light-emitting unit such that a potential of the latent-image bearing member is within a range in which the developing process is not performed by the developing device, the second light-emitting unit emitting light when the first light-emitting unit emits light.

2. The exposure apparatus according to claim 1, wherein the second light-emitting unit includes an organic electroluminescence element.

3. The exposure apparatus according to claim 1, wherein a plurality of the first light-emitting units are arranged along the main scanning direction, and wherein the number of the second light-emitting units is at least one, each second light-emitting unit correcting the amount of light to which the latent-image bearing member is exposed by emitting light simultaneously with two or more of the first light-emitting units.

4. The exposure apparatus according to claim 3, wherein the at least one second light-emitting unit includes one or more oblong elements that are disposed next to the first light-emitting units and arranged in the main scanning direction.

5. The exposure apparatus according to claim 1, further comprising:

a detector that detects an amount of light emitted from the first light-emitting unit, wherein the second light-emitting unit emits light so as to compensate for a shortage in the amount of light when the amount of light detected by the detector decreases.

6. The exposure apparatus according to claim 1, wherein the amount of light emitted from the second light-emitting unit is substantially constant, and the amount of light to which the latent-image bearing member is exposed is adjusted by the first light-emitting unit.

7. An image forming apparatus comprising:

a latent-image bearing member configured to bear a latent image;

the exposure apparatus according to claim 1, the exposure apparatus irradiating the latent-image bearing member with light to form the latent image; and a developing device that develops the latent image on the latent-image bearing member using a developer.

8. An image forming unit comprising:

one of a latent-image bearing member configured to bear a latent image, a charging device that charges the latent-image bearing member, and a developing device that develops the latent image on the latent-image bearing member using a developer; and the exposure apparatus according to claim 1, the exposure apparatus irradiating the latent-image bearing member with light to form the latent image, wherein the image forming unit is capable of being detachably attached to an image forming apparatus.

9. The exposure apparatus according to claim 1, wherein the second light-emitting unit emits an amount of light smaller than that emitted by the first light-emitting unit.

* * * * *